US008159150B2

(12) United States Patent
Ashdown et al.

(10) Patent No.: US 8,159,150 B2
(45) Date of Patent: Apr. 17, 2012

(54) METHOD AND APPARATUS FOR LIGHT INTENSITY CONTROL

(75) Inventors: Ian Ashdown, West Vancouver (CA); Damien Loveland, Richmond (CA); Ingo Speier, Saanichton (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 544 days.

(21) Appl. No.: 12/297,710

(22) PCT Filed: Apr. 23, 2007

(86) PCT No.: PCT/CA2007/000678

§ 371 (c)(1),
(2), (4) Date: Jan. 26, 2009

(87) PCT Pub. No.: WO2007/121574

PCT Pub. Date: Nov. 1, 2007

(65) Prior Publication Data

US 2009/0189530 A1 Jul. 30, 2009

Related U.S. Application Data

(60) Provisional application No. 60/820,749, filed on Jul. 28, 2006, provisional application No. 60/834,078, filed on Jul. 26, 2006, provisional application No. 60/745,359, filed on Apr. 21, 2006.

(51) Int. Cl.

| | |
|---|---|
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl. ..... 315/307; 315/291; 315/149

(58) Field of Classification Search ..... 315/312, 315/35, 36, 49, 64, 88, 95, 112, 121, 130, 315/137, 152, 161, 177, 178, 184, 185, 195, 315/201, 210, 228, 250, 288, 292, 158, 307, 315/149; 250/205

See application file for complete search history.

(56) References Cited

U.S. PATENT DOCUMENTS 6,127,783 A * 10/2000 Pashley et al. ..... 315/149
6,441,558 B1 * 8/2002 Muthu et al. ..... 315/149

(Continued)

OTHER PUBLICATIONS

Eric Kiser; "Digital Decoding Simplified", Circuit Cellar Issue 182, pp. 22-28, Sep. 2005.

*Primary Examiner* — Shawki S Ismail
*Assistant Examiner* — Dylan White
(74) *Attorney, Agent, or Firm* — Mark L. Beloborodov

(57) ABSTRACT

The present invention provides a method and apparatus for optical feedback control for an illumination device, wherein the control signal for each array of one or more light-emitting elements corresponding to a particular color, is independently configured using a modification signal whose frequency is different for each color. Electronic filters whose center frequencies are substantially equal to the modification signal frequencies of the drive currents for the light-emitting elements are used to discriminate between the radiant flux corresponding to each of the different colors of light-emitting elements, from a sample of the mixed radiant flux output collected by one or more optical sensors. The output of an individual electronic filter is substantially directly proportional to the radiant flux output of the light-emitting elements of the associated color, which together with the desired luminous flux and chromaticity of the output light, the controller can use to adjust the control signals.

19 Claims, 6 Drawing Sheets

U.S. PATENT DOCUMENTS

| | | | | |
|---|---|---|---|---|
| 6,445,139 | B1 | 9/2002 | Marshall et al. | |
| 6,495,964 | B1 * | 12/2002 | Muthu et al. | 315/149 |
| 6,507,159 | B2 * | 1/2003 | Muthu | 315/307 |
| 6,510,995 | B2 * | 1/2003 | Muthu et al. | 235/454 |
| 6,596,977 | B2 | 7/2003 | Muthu et al. | |
| 6,600,562 | B1 | 7/2003 | Chang | |
| 6,741,351 | B2 | 5/2004 | Marshall et al. | |
| 6,753,661 | B2 * | 6/2004 | Muthu et al. | 315/307 |
| 6,894,442 | B1 * | 5/2005 | Lim et al. | 315/291 |
| 7,026,769 | B2 * | 4/2006 | Lee et al. | 315/291 |
| 7,319,298 | B2 * | 1/2008 | Jungwirth et al. | 315/307 |
| 7,573,210 | B2 * | 8/2009 | Ashdown et al. | 315/307 |
| 7,781,990 | B2 * | 8/2010 | Huang et al. | 315/360 |
| 7,812,297 | B2 * | 10/2010 | Blaut et al. | 250/205 |
| 2003/0076056 | A1 * | 4/2003 | Schuurmans | 315/291 |
| 2006/0001613 | A1 | 1/2006 | Routley et al. | |
| 2006/0245174 | A1 * | 11/2006 | Ashdown et al. | 362/85 |
| 2008/0040512 | A1 * | 2/2008 | Nakayama et al. | 709/251 |
| 2011/0018465 | A1 * | 1/2011 | Ashdown | 315/294 |

* cited by examiner

METHOD AND APPARATUS FOR LIGHT INTENSITY CONTROL

This application is a national stage application under 35 U.S.C. §371 of International Application No. PCT/CA2007/000678 filed on Apr. 23, 2007 and published in the English language on Nov. 1, 2007 as International Publication No. WO2007/121574, which claims priority to U.S. Provisional Application Ser. No. 60/745,359, filed on Apr. 21, 2006, U.S. Provisional Application Ser. No. 60/820,749, filed on Jul. 28, 2006, and U.S. Provisional Application Ser. No. 60/834,078, filed on Jul. 26, 2006, all of which are hereby incorporated herein by reference.

FIELD OF THE INVENTION

The present invention pertains to illumination systems and more particularly to a light intensity control method and apparatus for illumination systems.

BACKGROUND

Light-emitting diodes (LEDs) are semiconductor devices that convert electrical energy into electromagnetic radiation, including visible light. Due to their reliability, high luminous efficacy and low maintenance requirements, LEDs are increasingly being used in various lighting applications such as ambient lighting, signage, advertising, display lighting, and backlit lighting applications.

It is well known that light of a desired spectral composition or, in photometric terms, a desired chromaticity and luminous flux, can be generated by intermixing adequate amounts of light from different colour light sources. When light from, for example, different colour LEDs is intermixed, the chromaticity of the mixed light can be sufficiently accurately determined by characteristics such as the intensities, center wavelengths and spectral bandwidths of the LEDs.

The characteristics of LEDs can vary for a number of reasons, for example, device aging and/or fluctuations in device operating temperature. These variations can cause undesirable effects under operating conditions of the LEDs. Possible solutions include optical feedback control to monitor the luminous flux output of the different colour LEDs and to adjust the drive currents of the LEDs such that the luminous flux output and chromaticity of the light emitted by each LED or at least the mixed light generated by a group of LEDs remains substantially constant. Monitoring the emitted light requires some means of measuring the luminous flux output per LED colour or per LED, for example.

To date, several optical feedback solutions have been proposed to detect and evaluate the luminous flux output and chromaticity of the output light of a lighting device in order to monitor these characteristics. For instance, U.S. Pat. No. 6,600,562 teaches an array of photosensors each having a selected colour filter responsive to light of a selected colour. These photosensors however, are prone to optical crosstalk due to the overlap in the spectral radiant power distribution of the light emitted by various colours of LEDs. This optical crosstalk can reduce the accuracy of the light information collected by the photosensors.

U.S. Pat. No. 6,741,351 describes a LED luminaire with multi-channel colour sensors for optical feedback, wherein each channel is comprised of a broadband photosensor and a colour filter with transmittances that approximate that of the red, green and blue LED spectral radiant power distributions. Since the spectral radiant power distributions of the LEDs tend to overlap for the different colours, channel crosstalk is inevitable and can limit the performance of the optical feedback system.

A partial solution to this optical crosstalk problem is to select bandpass filters with narrow bandwidths and steep cutoff characteristics. Although satisfactory performance levels for such filters can be achieved using multilayer interference filters, these interference filters can be expensive and typically require further optics for collimating the emitted light, as the interference filter characteristics depend on the incidence angle at which the light impinges on these filters.

Another problem associated with interference filters is that the center wavelength of an LED depends on the LED junction temperature and this center wavelength can vary significantly depending on the type of LED. In addition, the bandpass transmittance spectra of interference filters are also temperature dependent. The output signal of the photosensor therefore depends on the spectral radiant power distribution of the LED as modified by the bandpass characteristics of the interference filter associated therewith. Hence there exist situations where the output signal of the photosensor may change with ambient temperature even if the LED spectral radiant power distribution remains constant, which can further limit the performance of the sensor system.

U.S. Pat. No. 6,127,783 describes how radiation from each LED colour is controlled by an electronic control circuit, which can selectively turn off the LEDs, which are the colours not being measured, in a sequence of time pulses and uses a single broadband optical sensor for detection. A problem with this approach is that colour balance is periodically and potentially drastically altered each time the LEDs are de-energized, thereby possibly causing noticeable flicker. Since the optical sensor requires a minimum amount of time to sense the radiant flux of the energized LEDs accurately and with an acceptable signal-to-noise ratio, the choice of sampling frequencies can be limited by the sensitivity and noise characteristics of the optical sensor. A limited sampling frequency can result in lower sampling resolution and longer response times for the optical feedback loop. Since light from no more than one LED colour is measured at a time, this approach for optical data collection can increase the feedback loop response time by about the number of different LED colours used in the system. For example, for a system with red, green, and blue LED clusters the response time can be multiplied by factor of about three, and for a system with red, green, blue, and amber LED clusters the response time can be multiplied by a factor of about four.

U.S. Pat. No. 6,445,139 describes a luminaire having a plurality of LEDs producing light of different colours. The light output of each colour is measured by an electronic control circuit that turns OFF the LEDs for the colours not being measured in a sequence of time pulses. The average light output during the measuring period is substantially equal to the nominal continuous light output during the ordinary operation to avoid visible flicker. Similarly, U.S. Pat. No. 6,495,964 seeks to alleviate the flicker by selectively measuring the light output of the LEDs in a sequence of time pulses, whereby the current for the colour being measured is turned off. Neither of these proposed solutions, however, addresses periodic and potentially drastic changes in colour balance or degradation in feedback loop response time due to the deactivation sequences required for light sampling.

As described in U.S. Pat. No. 6,596,977, the light output of the LEDs is sampled by a broadband optical sensor during PWM drive current pulses whenever the drive current has reached full magnitude. This procedure can avoid the effect of the rise and fall times of the PWM pulse. The average drive current can then be determined by low pass filtering. A difficulty associated with this approach can be that the PWM pulses must be synchronized such that at least one LED colour is de-energized for a finite period of time during the PWM period. This requirement can prevent operation of all different colour LEDs at full power at 100% duty factor. Another disadvantage associated with the average light sensing method is that the sampling period typically must provide sufficient time for the optical sensor to reliably measure the radiant flux of the energized LEDs. In addition this light sensing method requires that the LED colours are to be measured sequentially, which can limit the feedback loop response time.

Based on the above, there is a need for a new method and apparatus for light intensity control for a luminaire.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a method and apparatus for light intensity control. In accordance with an aspect of the present invention there is provided an illumination device for generating light having a desired luminous flux and chromaticity, the illumination device comprising: one or more first arrays of one or more light-emitting elements adapted to generate first light having a first spectral power distribution, and one or more second arrays of one or more light-emitting elements adapted to generate second light having a second spectral power distribution different than the first spectral power distribution; a first current driver operatively coupled to one or more first arrays, the first current driver configured to selectively supply electrical drive current to the one or more first arrays based on a first control signal, and a second current driver operatively coupled to the one or more second arrays, the second current driver configured to selectively supply electrical drive current to the one or more second arrays based on a second control signal; an optical sensor for sensing a portion of output light which is a combination of the first light and second light, the optical sensor configured to generate an optical signal representative of the mixed radiant flux of the output light; and a controller interfaced with the first current driver, second current driver, and the optical sensor, the controller being configured to generate the first control signal and second control signal, said first control signal at least in part configured using a first modification signal and the second control signal at least in part configured using a second modification signal, the controller being configured to electronically filter the optical signal based on the first modification signal and second modification signal thereby determining optical characteristics of the first light and second light, the controller generating the first control signal and second control signal based on the characteristics of the first light and second light respectively and further based on the desired luminous flux and chromaticity of the output light.

In accordance with another aspect of the present invention, there is provided a method for generating output light of a desired luminous flux and chromaticity, the method comprising the steps of: generating a first drive current for one or more first arrays of one or more light-emitting elements at least in part using a first modification signal; generating a second drive current for one or more second arrays of one or more light-emitting elements at least in part using a second modification signal; generating an optical signal representative of output light characteristics, the output light being a mixture of light emitted by the one or more first arrays and one or more second arrays; electronically filtering the optical signal based on the first modification signal thereby obtaining a first radiant flux representative of light emitted by the one or more first arrays; electronically filtering the optical signal based on the second modification signal thereby obtaining a second radiant flux representative of light emitted by the one or more second arrays; comparing a combination of the first radiant flux and second radiant flux with the desired luminous flux and chromaticity; and adjusting the first drive current and the second drive current if required.

DETAILED DESCRIPTION OF THE INVENTION

Definitions

Figure 1:
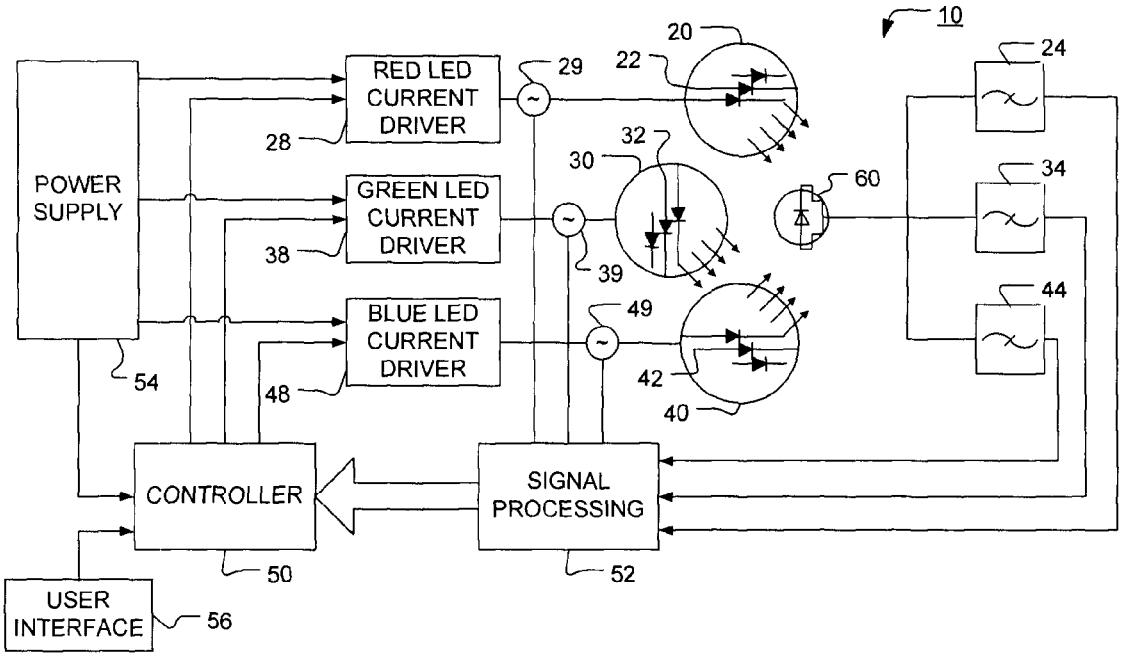
FIG. 1 illustrates a block diagram of an illumination system according to an embodiment of the present invention.

The term "light-emitting element" (LEE) is used to define any device that emits radiation in any region or combination of regions of the electromagnetic spectrum for example, the visible region, infrared and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, blue or UV pumped phosphor coated light-emitting diodes, optically pumped nanocrystal light-emitting diodes or other similar devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

The term "optical sensor" is used to define an optical device having a measurable sensor parameter in response to a characteristic of incident light, such as its luminous flux or radiant flux.

The term "broadband optical sensor" is used to define an optical sensor that is responsive to light within a wide range of wavelengths, such as the visible spectrum for example.

The term "narrowband optical sensor" is used to define an optical sensor that is responsive to light within a narrow range of wavelengths, such as the red region of the visible spectrum for example.

The term "controller" is used to define a device having a programmable central processing unit (CPU), for example a microcontroller, and peripheral input/output devices, for example analog-to-digital converters, to monitor parameters from devices that are coupled to the controller. These input/output devices can also permit the central processing unit of the controller to communicate with and control the devices coupled to the controller, such as LED drivers for example. The controller can optionally include memory such as one or more storage media. The memory can be volatile and non-volatile computer memory such as RAM, PROM, EPROM, and EEPROM, floppy disks, compact disks, optical disks, magnetic tape, or the like, wherein data and control programs for example software, microcode, or firmware, for monitoring or controlling the devices coupled to the controller can be stored. Optionally, the controller also provides a means for converting user-specified operating requirements into control signals to control the peripheral devices coupled to the controller. The controller can be interfaced with a user interface such as a keyboard to receive user-specified commands. Furthermore, the controller can be operatively coupled with other controllers in a network.

The term "chromaticity" is used to define the perceived colour impression of light according to standards of the Illuminating Engineering Society of North America.

The term "luminous flux" is used to define the instantaneous quantity of visible light emitted by a light source according to standards of the Illuminating Engineering Society of North America.

The term "spectral radiant flux" is used to define the instantaneous quantity of electromagnetic power emitted by a light source at a specified wavelength according to standards of the Illuminating Engineering Society of North America.

The term "spectral radiant power distribution" is used to define the distribution of spectral radiant flux emitted by a light source over a range of wavelengths, such as the visible spectrum for example.

The term "radiant flux" is used to define the sum of spectral radiant flux emitted by a light source over a specified range of wavelengths.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention arises from the realization that the luminous flux output and chromaticity of the output light from a combination of light-emitting elements with different colours can be maintained at a desired level by optical feedback adjusting the drive current of the light-emitting elements. However, maintaining consistent output light using optical feedback control is difficult to achieve due to limitations in an optical feedback control system such as crosstalk between narrowband optical sensors and low sampling frequency at which light from the light-emitting elements is measured. These undesired effects in turn can reduce the response time of the feedback control system and can introduce errors in the amount of radiant flux detected and evaluated from different colour light-emitting elements.

The present invention seeks to overcome these undesired effects on an optical feedback control system of an illumination device, whereby the control signal for each array of one or more light-emitting elements corresponding to a particular colour, is independently configured using a modification signal whose frequency is different for each colour. Electronic filters whose center frequencies are substantially equal to the modification signal frequencies of the drive currents for the light-emitting elements are used to discriminate between the radiant flux corresponding to each of the different colours of light-emitting elements, from the sample of the mixed radiant flux output collected by, for example one or more broadband optical sensors. The output of an individual electronic filter is substantially directly proportional to the radiant flux output of the light-emitting elements of the associated colour. This information can subsequently be used by the controller together with the desired luminous flux and chromaticity of the output light, in order to generate subsequent control signals for each colour of light-emitting element arrays of the illumination device.

Since the modification signal frequency for each colour is independent of its spectral radiant power distribution, a filter's output signal is substantially unaffected by the spectral power distribution overlap of the radiant flux emitted by different colour light-emitting elements.

In another embodiment of the present invention an illumination system is formed from a plurality of illumination devices, wherein the illumination system comprises an optical feedback control system whereby the control signal for each array of light-emitting elements corresponding to a particular colour in a particular illumination device is independently configured using a modification signal whose frequency is different for each colour and each illumination device. Electronic bandpass filters whose center frequencies are substantially equal to the modification signal frequencies of the drive currents for the light-emitting elements are used to discriminate between the radiant flux corresponding to each of the different colours of light-emitting elements of each illumination device, from the sample of the mixed radiant flux output collected by a broadband optical sensor. The output of an individual bandpass filter is substantially directly proportional to the radiant flux output of the light-emitting elements of the associated colour and illumination device. This information can subsequently be used by the controller in each illumination device together with the desired luminous flux and chromaticity of the emitted light from that illumination device, in order to generate subsequent control signals for each colour of light-emitting element array.

To realize the present invention it can be necessary to detect certain harmonics in a sensed signal. As is widely known, superimposed harmonics of input signals can be reliably extracted and separated from quasi random signals such as noise signals by decomposing the input signal into a series of harmonic frequency signals using a Fourier Transformation, for example. As is well known to a person skilled in the art, other transformations, using base functions other than sinusoidal functions exist, and can be used depending on the nature of the signal and the type of information to be extracted from the signal. Hence light-emitting element drive current modification signals for an illumination device can be made small enough yet distinguishable by frequency while maintaining utility of the emitted light for illumination purposes.

In one embodiment of the present invention, an adequate sensor and signal processing system for sensing light and for processing the sensed signal can comprise a broadband photosensor and a predetermined number of bandpass filters for determining the modulated intensities and average continuous intensities for the light emitted by the different chromaticities of light-emitting elements. The optical sensor and signal processing system can comprise any type of passive or active analog or digital, discrete-time (sampled) or continuous-time, linear or non-linear, infinite impulse response (IIR type) or finite impulse response (FIR type) analog, digital subsystem, or the like as would be readily understood by a person skilled in the art. In one embodiment of the present invention, electronically filtering of the optical signal from the optical sensor can be performed using one or a combination of hardware circuitry filtering and digital filtering.

The drive current of the light-emitting elements can be adjusted using a modification signal. The amplitudes and/or frequencies of the modification signal for each colour and optionally each illumination device can be chosen to avoid undesired illumination effects. The drive current can be modulated continuously or intermittently. In addition, in one embodiment for example, in order to improve signal to noise ratios, short drive current amplitude modulation bursts can allow the modification of the drive current with high amplitudes whereas low amplitudes can allow modulations for longer periods or continuous modulation.

In one embodiment of the present invention, an illumination device can be configured such that under operating conditions the one or more sensors receive light that practically only originates from the illumination device. Alternatively the illumination device can be configured such that under operating conditions its sensor(s) can also receive practically relevant amounts of ambient light such as from other illumination devices such as from a nearby second illumination device, for example. The illumination device can also be configured such that its sensors practically primarily receive a portion of the light that it provides to illuminate objects and which is reflected back to the sensor(s). This can be used, for example, to control a multi-colour LEE based illumination device that is configured to mix differently coloured light effectively and provide a desired illumination pattern only at predetermined distances from the illumination device.

Illumination Device with Optical Feedback Apparatus

FIG. 1 illustrates a block diagram of an illumination device 10 according to an embodiment of the present invention. As illustrated, the illumination device 10 includes arrays 20, 30 and 40 each array having one or more light-emitting elements 22, 32 and 42. In this embodiment the light-emitting elements 22, 32 and 42 can generate radiation in the red, green, and blue regions of the visible spectrum. Alternative embodiments of the present invention can have different numbers of nominal light-emitting element colours or additionally include light-emitting elements of other colours such as amber, pink or white etc. The light-emitting elements 22, 32 and 42 can be thermally connected to a common heat sink or alternatively to separate heat sinks (not shown) for improved thermal management of certain operating conditions of the light-emitting elements 22, 32 and 42. Embodiments of the illumination device can include mixing optics (not shown) for intermixing the light emitted by the different colour light-emitting elements.

It is noted that when differently coloured light-emitting elements emit light which is adequately mixed, controlling colour and intensity of the mixed light is then a matter of controlling the amount of light provided by each of the same colour light-emitting elements. The colour of the mixed light can thus be controlled within a range of colours defined by the colour gamut of the illumination device. The colour gamut is defined by the different colour light-emitting elements within the illumination device subject to achievable operating conditions.

Current drivers 28, 38 and 48 are coupled to arrays 20, 30 and 40, respectively, and are configured to separately supply current to the red light-emitting elements 22, green LEEs 32, and blue light-emitting elements 42 in arrays 20, 30 and 40. A power supply 54 coupled to the current drivers 28, 38 and 48 can provide electrical power. The current drivers 28, 38 and 48 control the amount of drive current supplied to and hence the amount of light emitted by light-emitting elements 22, 32 and 42. The current drivers 28, 38 and 48 are configured to regulate the supply of current to each array 20, 30 and 40 separately so as to control the luminous flux and chromaticity of the combined mixed light.

In one embodiment, the current drivers 28, 38 and 48 provide a pulsed drive current, for example a pulse width modulated (PWM) or pulse code modulated (PCM) drive current for controlling the luminous flux and chromaticity of the combined emitted light of the red light-emitting elements 22, green light-emitting elements 32, and blue light-emitting elements 42. For PWM controlled light-emitting elements the average drive current through light-emitting elements 22, 32 or 42 is proportional to the duty factor of the PWM control signal. Therefore it is possible to control the amount of light generated by light-emitting elements 22 32 or 42 by adjusting the duty factor for each array 20, 30 and 40, respectively. The dimming of the red light-emitting elements 22, green light-emitting elements 32, or blue light-emitting elements 42 affects the mixed radiant flux output of the illumination device. The current drivers can be current regulators, switches or other similar devices as would be known to those skilled in the art. Alternate control techniques for controlling the activation of the light-emitting elements would be readily understood by a worker skilled in the art.

Those having skill in the art will recognize that the PWM control signals generated by the controller can be implemented as computer software or firmware on a computer readable medium having instructions for determining the PWM control signal sequence.

In one embodiment, current sensors 29, 39 and 49 are coupled to the output of current drivers 28, 38 and 48 and continuously sense the drive current supplied to the arrays 20, 30 and 40. The current sensors 29, 39 and 49 can comprise a fixed resistor, a variable resistor, an inductor, a Hall Effect current sensor, or other element which has a known voltage-current relationship and can provide an adequately accurate indication of the drive current.

In one embodiment, the instantaneous forward currents supplied to the arrays 20, 30 and 40 are measured by the current sensors 29, 39 and 49 which can communicate the sensed signals to a signal processing system 52 coupled to the controller 50. The signal processing system 52 can pre-process the drive current signals from the sensors 29, 39 and 49 provide respective information to the controller 50. The signal processing system 52 can include analog-to-digital (A/D) converters, amplifiers, filters, microprocessors, signal processors or other signal processing devices as would be readily understood by a person skilled in the art.

In an alternative embodiment, the output signals from the current sensors 29, 39 and 49 are directly forwarded (not illustrated) to a controller for processing. In a further alternative embodiment, the peak forward currents for each array 20, 30 or 40 can be fixed to a pre-set value to avoid measuring the instantaneous forward current supplied to arrays 20, 30 and 40 at a given time.

The controller 50 is coupled to current drivers 28, 38 and 48. The controller 50 is configured to independently adjust each average forward current by separately adjusting the duty cycles of each of current drivers 28, 38 and 48. The controller 50 transmits control signals to each of current drivers 28, 38 and 48. The control signals determine the current generated by the current drivers 28, 38 and 48 which is supplied to red light-emitting elements 22, green light-emitting elements 32, and blue light-emitting elements 42, respectively. Variations of the drive current, which are intended to control the time-averaged amount of light emitted by the light-emitting elements, are desirably fast enough to avoid perceivable flicker.

The illumination device 10 further includes a broadband optical sensor 60 for sensing the emitted light. The output of the optical sensor 60 is coupled to the inputs of electronic bandpass filters 24, 34 and 44. The bandpass filters 24, 34 and 44 can be configured so that their nominal center frequencies equal the frequencies of the carrier signals used for amplitude modulation of the light-emitting element drive currents. The bandpass filters can be configurable so that controller 50 can control their center frequencies. The optical sensor 60 provides a signal representative of the mixed radiant flux output of the emitted light. The optical sensor 60 can be responsive to the spectral radiant power distributions generated by the red light-emitting elements 22, green light-emitting elements 32, and blue light-emitting elements 42 so as to monitor the contributions of light-emitting elements 22, 32 and 42 to the mixed radiant flux output of the illumination device. The optical sensor can be a phototransistor, a photosensor integrated circuit, an adequately configured LED or a silicon photodiode with an optical filter etc.

In one embodiment of the present invention, the optical sensor is a silicon photodiode with an optical filter that has a substantially constant responsivity to spectral radiant flux within the visible spectrum. An advantage of using an optically filtered silicon photodiode is that this configuration does not require any multilayer interference filters. As a result, this format of optical sensor does not require substantially collimated light. In the present invention, the control signals for activation of the light-emitting elements are independently modified by the controller 50 with a modification signal whose frequency is different for different colour light-emitting elements and can be configured to be different from those used by another illumination device.

In another embodiment of the present invention, the optical signal representative of the radiant flux incident upon the optical sensor 60 can be electronically pre-processed with amplifier circuitry associated with the optical sensor or it can be processed by analog or digital means in the controller 50.

In one embodiment, a user interface 56 is operatively coupled to the controller 50 to obtain the desired values of luminous flux output and chromaticity of the output light from a user of the illumination device. Alternately, the illumination device can have predetermined luminous flux output and chromaticity values of the output light stored in memory associated therewith, for example memory operatively coupled to the controller.

Figure 2:
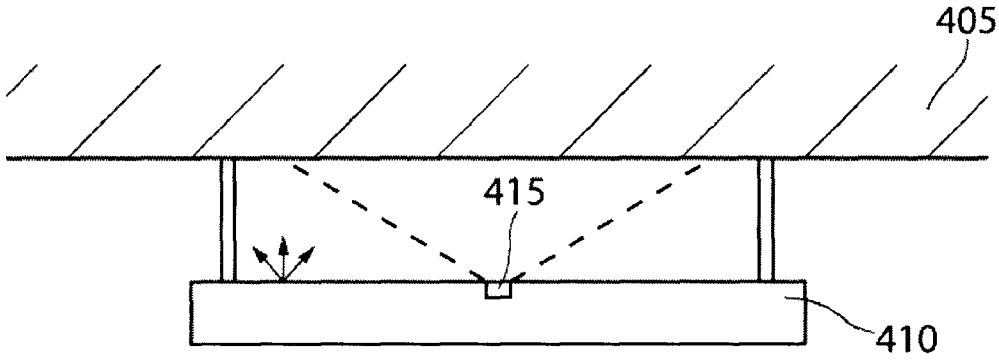
FIG. 2 schematically illustrates a luminaire for indirect lighting according to one embodiment of the present invention.

FIG. 2 illustrates a luminaire including an illumination device according to an embodiment of the present invention. The luminaire 410 is used in an indirect illumination application in which an optical sensor 415 receives light which is reflected from an illuminated target surface 405, for example, a ceiling which is located at a certain distance. This setup can be useful in cases where, for example the light from the luminaire is sufficiently mixed only once it reaches the target surface. The illumination device inside the luminaire can be calibrated, for example at installation, so that its controller can account for colour shifts in the reflected light relative to the incident light which can arise from coloured target surfaces. The optical sensor 415 can be combined with an adequate optical system (not illustrated). For example, the optical system can comprise a plastic lens mounted directly on top of a photosensor. The optical system can be used for imaging purposes such that the light from the target surface can be focused on the optical sensor 415. Depending on the optical system the sensor can then sense light with an integral solid angle view of a certain portion of the target surface. This application scenario allows for luminaire designs with reduced light mixing requirements inside the luminaire.

Embodiments of the illumination device that are suitable for direct illumination applications can be configured differently. In this case the field of view of an optical system may include dynamic or moving objects including persons, for example. Different fractions of the total field of view may be occupied by dynamic objects depending on the size of the field of view. In such situations, the feedback control system of the illumination device can require a means to separate changes in the sensed reflected light that are caused by the moving objects from changes in the sensed reflected light that are caused by changes in the incident light. Therefore, certain embodiments of the present invention can have control systems which can be calibrated to respond only to slow sensor signal changes, for example as caused by aging of the light-emitting elements, and ignore changes on a second or minute timescale.

Figure 3:
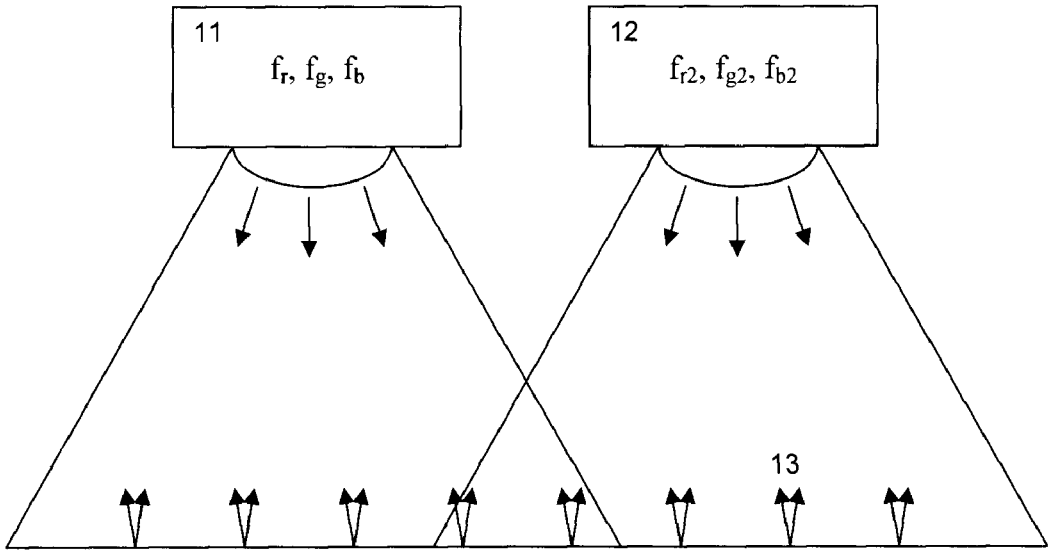
FIG. 3 schematically illustrates a setup of two luminaries according to an embodiment of the present invention.

FIG. 3 schematically illustrates a illumination system including luminaire 11 and luminaire 12 with each including an illumination device according to an embodiment of the present invention. The light emitted by luminaire 11 and luminaire 12 may be reflected back from a surface towards the illumination devices as indicated by arrows 13, such that light originating from one luminaire reaches the sensor(s) of the other luminaire or vice versa. This can potentially cause interference with the optical feedback system of the respective luminaire. In one embodiment of the present invention the illumination device associated with luminaire 11 uses modification signal frequencies $f_{r,1}$, $f_{g,1}$ and $f_{b,1}$, that adequately differ from the modification signal frequencies $f_{r,2}$, $f_{b,2}$ and $f_{g,2}$ used in the illumination device associated with luminaire 12. This enables each illumination device to discriminate light generated by it from light generated by another illumination device.

Amplitude Modulation Modification Signal

In one embodiment of the present invention, the control signals for activation of the light-emitting elements are independently amplitude-modulated by the controller with a carrier signal whose frequency is different for each colour of light-emitting element, for example the red light-emitting elements, green light-emitting elements, and blue light-emitting elements, and optionally also different for each illumination device of an illumination system. For example each of the respective PWM or PCM control signals for the red light-emitting elements, green light-emitting elements, and blue light-emitting elements, can be amplitude modulated with different carrier signals for each colour.

When adequately amplitude modulating the light-emitting element drive currents, radiant flux output measurements can be performed without sequentially selectively turning ON or OFF different colour light-emitting elements. Accordingly, deviations in the radiant flux outputs of the red light-emitting elements, green light-emitting elements, and blue light-emitting elements from the desired luminous flux and chromaticity, can be detected and compensated for by the controller. The measured radiant flux of the different colour light-emitting elements is substantially independent of practically relevant shifts in the center wavelengths of the light-emitting elements. Thus, while changes in light-emitting element junction temperatures may change the ratio of drive current to radiant flux output, typically consequent changes in light-emitting element center wavelength emission do not impact the measurements of the radiant flux output of the different colour light-emitting elements.

Figure 4:
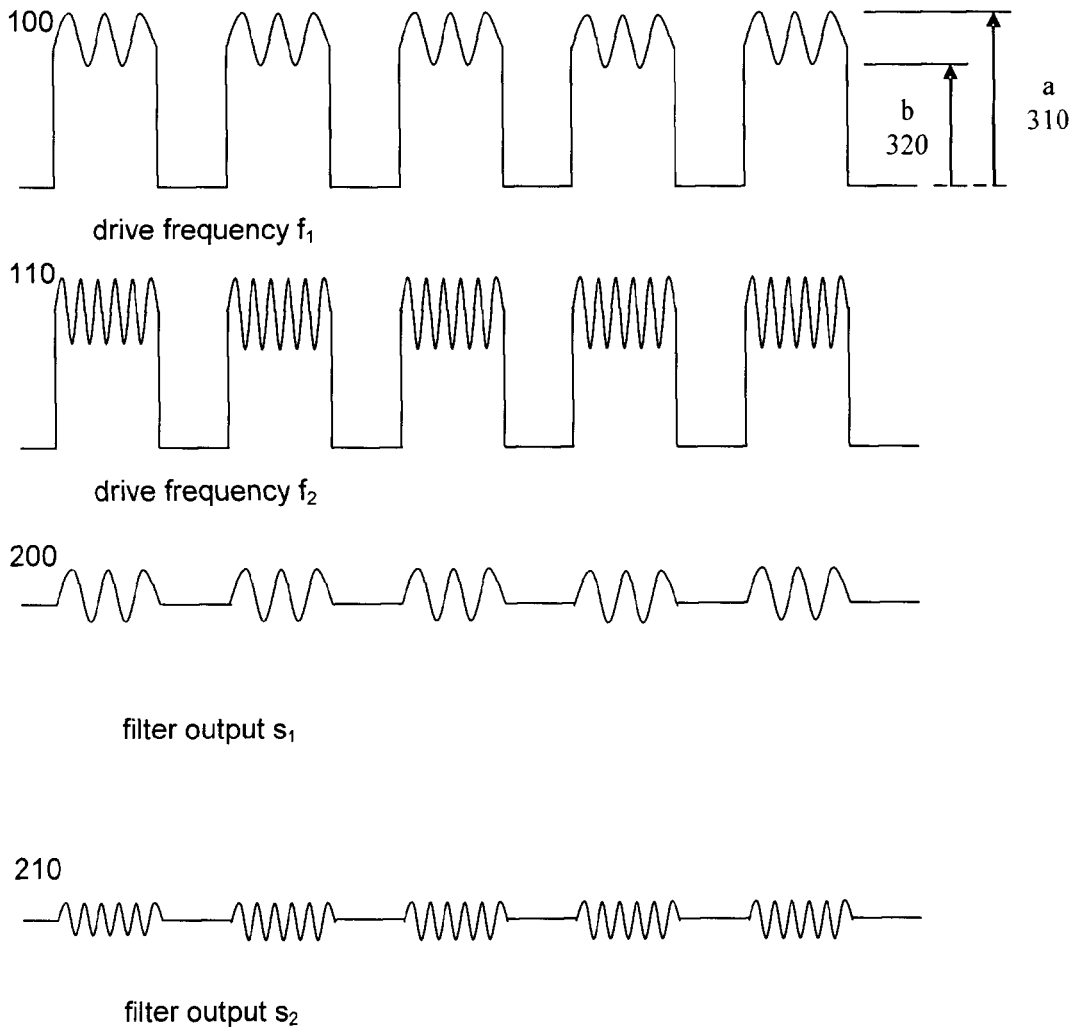
FIG. 4 illustrates signal diagrams with amplitude modulated PWM drive current signals and frequency filtered drive current signals according to one embodiment of the present invention.

In one embodiment, the depth d of the amplitude modulation signal is constant over time whenever the drive current assumes a non-zero magnitude, where d is defined by expression (1) as follows:

$$d=(a-b)/(a+b) \quad (1)$$

where a is the maximum peak amplitude and b is the minimum peak amplitude of the drive current when energized. FIG. 4 illustrates signal diagrams with examples of amplitude modulated PWM drive current signals and adequately frequency filtered drive current signals. It illustrates the amplitude modulated drive frequency 100 for a first array of one or more light-emitting elements and the amplitude modulated drive frequency 110 for a second array of one or more light-emitting elements according to an embodiment of the present invention. FIG. 4 further illustrates examples of filter outputs, 200 and 210 which may be associated with the light generated by the first and second arrays of light based on the drive frequencies 100 and 110, respectively. In one embodiment, as it can be observed from FIG. 4, the amplitude modulation depth d of the carrier signal tracks the maximum peak amplitude a 310 and minimum peak amplitude b 320 of the drive current as defined by the relationship in Equation 1. It can be seen from Equation 1, that the depth d of the carrier signal is proportional to the signal strength thereof.

The controller can control when and by how much the drive current is modulated. For example, for embodiments with PWM controlled light-emitting elements, the drive current may be modulated during every ON-portion of a PWM pulse. Alternatively only certain ON-portions selected according to a predetermined schedule may carry a modulation signal. It is noted that different arrays can have different maximum peak amplitudes a as well as different minimum peak amplitudes b. The controller can determine adequate amplitudes based on the instantaneous or time-averaged drive current supplied by the current drivers.

Sufficiently small light-emitting element drive current amplitude modulation frequencies in the range of $10^3$ to $10^7$ Hz merely directly linearly modulate the amount of light emitted by that light-emitting element across the practically relevant extent of the spectral distribution of the emitted light without causing any practically relevant undesired side effects. If properly configured, drive current amplitude modulation does not affect the utility of an LEE-based illumination device for general purpose space or indication illumination applications.

Accurately evaluating the radiant flux contributions from differently modulated light-emitting elements based on a single sensor signal obtained from a single broadband optical sensor sensing the mixed light can be achieved by processing respective components of the Fourier-transformed sensor signal. For a sensor with sufficient linear responsivity across the range of operating conditions, the output signal is directly proportional to the input signal. In embodiments with such a sensor the strength of the output sensor signal modulations relative to the strength of the output sensor signal corresponds to the strength of the input signal modulations relative to the strength of the input signal. Therefore the strength of the output sensor signal can be inferred by dividing the strength of the output sensor signal modulations by the known ratio between the input signal modulations and the input signal. If, for practical purposes, the responsivity of the sensor is not sufficiently linear but still unambiguously correlates the output and the input signal, the correlation can be linearized, which, for example, can be performed by a signal processing system or controller.

The bandpass filters can be implemented digitally in firmware based on, for example, the Goertzel algorithm or other efficient Discrete Fourier Transformation methods. The use of this procedure for digital filtering is widely known in the art and described in, for example, "Digital Decoding Simplified, " Eric Kiser, Circuit Cellar Issue 182, pp. 22-28, September 2005 and its citations.

In an alternative embodiment of the present invention, the output of each bandpass filter may be sampled with a peak detector amplifier to determine the instantaneous radiant flux output for the associated colour. The output of each bandpass filter may also be subjected to further low-pass filtering by way of low pass filters to determine the time-averaged radiant flux output for each colour, or by way of Kalman filters to predict short-term changes in the radiant flux of the emitted light.

The outputs of the bandpass filters are coupled to the controller. Based on the inferred radiant flux of each colour light-emitting elements from the bandpass filters, the controller can compensate for and adjust the amounts of drive current for the red light-emitting elements, green light-emitting elements, and blue light-emitting elements in order to maintain the luminous flux and chromaticity of the emitted light at desired levels.

In an alternative embodiment, the outputs of the bandpass filters can be operatively coupled to a proportional-integral-derivative (PID) feedback loop circuit that can be implemented in firmware in the controller. Alternatively, the PID feedback loop circuitry (not shown) can be a separate component operatively connected to the controller.

Properly configured electronic bandpass filters with sufficiently narrow bandwidths can be both quick and effectively eliminate crosstalk between light from different colour light-emitting elements. This can greatly improve the responsiveness of the optical feedback loop.

Amplitude Modulation Frequency Selection

In one embodiment of the present invention, an illumination device can perform a configuration operation. During the configuration the illumination device can, for example, generate light and modulate the amplitude of a portion of that light at one or more predetermined modulation frequencies and subsequently process all sensed responses at the modulation frequencies and the corresponding harmonics. If the control system detects no response in the sensed signal other than that originating from the modulation of its own light, it can use these frequencies for subsequent amplitude modulation of its light-emitting elements. If it receives a response that does not correlate with the amplitude modulation of its own light-emitting elements, the illumination device can change the one or more frequencies at which it modulates its own light-emitting elements and repeats the above operation until a sufficient number of available frequencies has been detected.

In another embodiment of the present invention, wherein an illumination system includes a plurality of illumination devices, an illumination device can scan for signals at frequencies in a predetermined sequence, accumulate an adequate number of free frequencies and use these free frequencies for subsequent amplitude modulation of its light-emitting elements.

In one embodiment of the present invention, the amplitude modulation frequencies of a particular illumination device can have a predetermined relationship that clearly identifies all other modulation frequencies used by that illumination device, for example when only one frequency is known.

It is noted that while two or more illumination devices can communicate with each other, each of them can be separately supplied with electrical energy. If the optical sensor of one illumination device receives enough light from any other illumination device, that illumination device can also detect the carrier signal frequencies of the other illumination device and reconfigure itself as described above.

In another embodiment, illumination devices in an illumination system are connected together for control purposes, and signals can be passed between the illumination devices to communicate information about the carrier signal frequencies being used. The physical connection can be wired, wireless, optical or acoustic etc and can be used to support any known suitable communication protocols including TCP/IP, for example.

In one embodiment of the present invention, the controller is adapted to selectively turn OFF a selected array and monitor the output signals from the electronic filters to process the light emitted from the arrays that remain energized in order to assign a unique center frequency to the selected array and the respective electronic filters.

Embodiments of the present invention can be configured to continuously, frequently or intermittently evaluate amplitude modulation frequencies during a self-configuration procedure in order to avoid sharing the same or similar modulation frequencies with other nearby potentially interfering illumination device. For this purpose the control system of the illumination device can be configured to include switching the illumination device into a passive scan mode while sensing and scanning for a sufficient number of free available modulation frequencies. The control system can configure the illumination device to enter the scan mode for a brief period of time, for example, during a switch ON of the illumination device or during an OFF period. The control system can scan a predetermined frequency range for modulations in the sensed light according to a predetermined scheme until a sufficient number of free frequencies or bands of frequencies have been determined. The control system can subsequently retain the available frequencies in a memory within the illumination device. The controller can subsequently assign a free modulation frequency to each light-emitting element colour, and use these frequencies to modulate the amplitudes of the respective light-emitting element drive currents.

Optical Feedback Method

Figure 5:
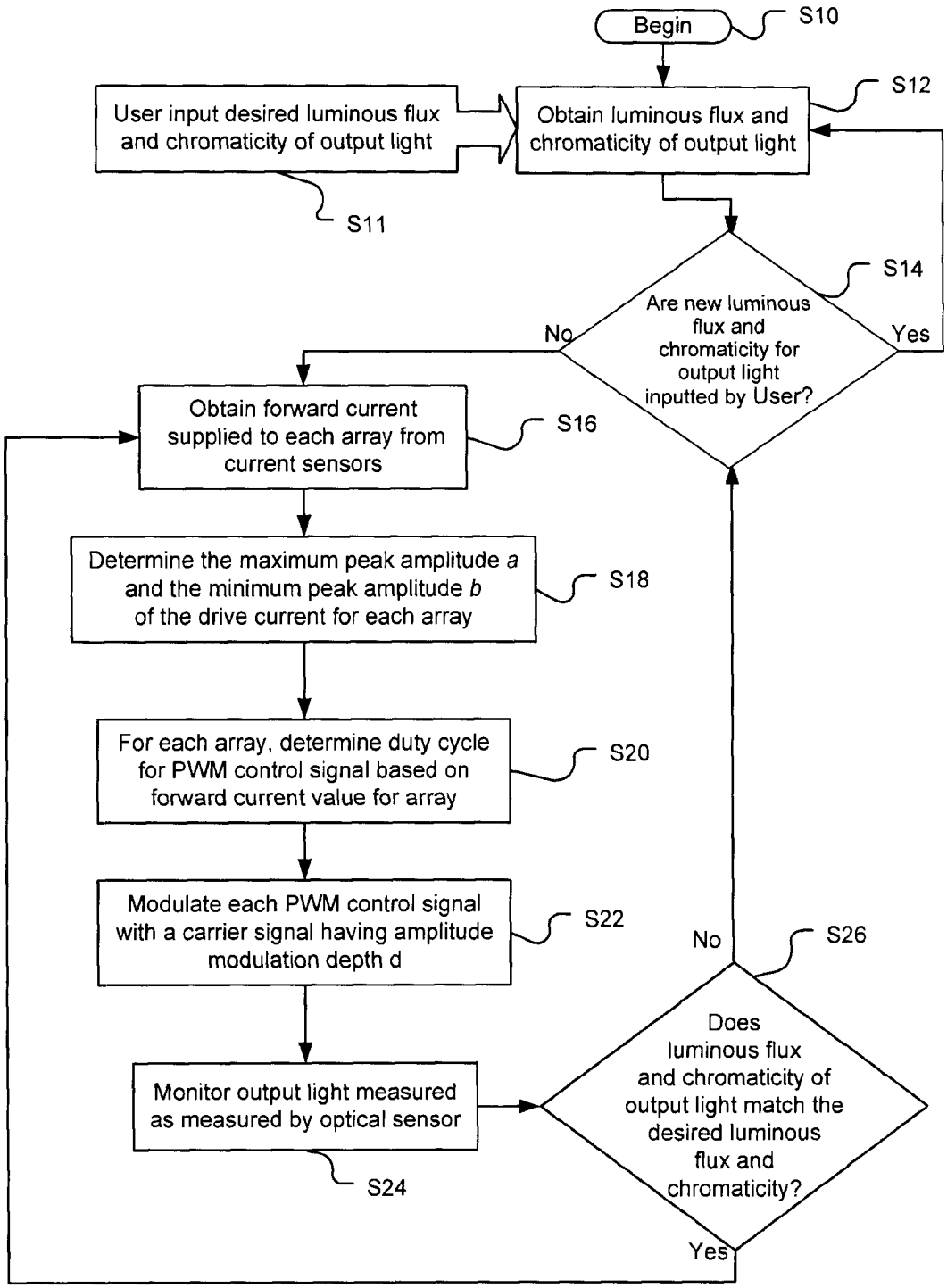
FIG. 5 illustrates a flow chart showing a sequence of steps for a control method according to an embodiment of the present invention.

FIG. 5 illustrates a flow chart comprising a sequence of steps of a control method for the controller to maintain the luminous flux and chromaticity of the emitted light from an illumination device according to an embodiment of the present invention. As shown in FIG. 5, a user of the illumination device communicates the desired luminous flux and chromaticity of the emitted light to the controller by way of the user interface as shown in Step S11. The user preference values are subsequently obtained by the controller in Step S12. At Step S14, the controller assesses whether any new desired luminous flux and chromaticity information for the emitted light have been input by the user. This assessment can be based on a comparison between the current values with the new values input by the user. If the user preference values have changed, the controller obtains the new luminous flux and chromaticity (Step S12). In the negative, the controller obtains the amount of instantaneous or time-averaged forward current supplied to each array from current sensors as shown in Step S16.

During Step 18, the controller determines the values of the maximum peak amplitude a and the minimum peak amplitude b of the drive current for each array. On the basis of said values for a and b, the controller determines in Step 20 the duty cycle for a PWM control signal for each of the arrays. Each PWM control signal is subsequently modulated with a carrier frequency having an amplitude modulation d defined by expression (1), as indicated by Step S22. As explained in Step S24 of FIG. 5, the controller also monitors the luminous flux and chromaticity of the emitted light as measured by the optical sensor. The signals received from the optical sensor, which are representative of the emitted light, are electronically filtered based on the carrier frequencies used for the amplitude modulation of the drive current for each array, thereby determining radiant flux of each array of light-emitting elements. The controller assesses whether the measured luminous flux and chromaticity correspond to the desired luminous flux and chromaticity preferred by the user (Step S26). In the event that the user preference values match those measured by the optical sensor, the controller continues operating with the current parameters. However, if there exist discrepancies between the user preference values and the luminous flux and chromaticity of the emitted light measured by the optical sensor, the controller verifies whether new user preference values have been entered (Step S14) and provides a correction factor in the PWM control signals and carrier signals based on the user preference values and the operating conditions, as outlined in Step S16 to Step S24.

In one embodiment, the amplitude modulation depth d may be increased as the drive current or PWM duty factor is reduced, thereby dimming the luminous flux output of the different colour light-emitting elements, for example, the red, green and blue light-emitting elements. An advantage of this embodiment is that the optical sensor output signal is correspondingly increased, thereby increasing the signal-to-noise ratio.

In another embodiment, two or more of the carrier signals may have the same center frequency but can be further modulated with orthogonal digital or analog codes such that complementary bandpass filters with the same center frequency are responsive to only one signal.

PWM Pulse Frequency Modification Signal

Figure 6:
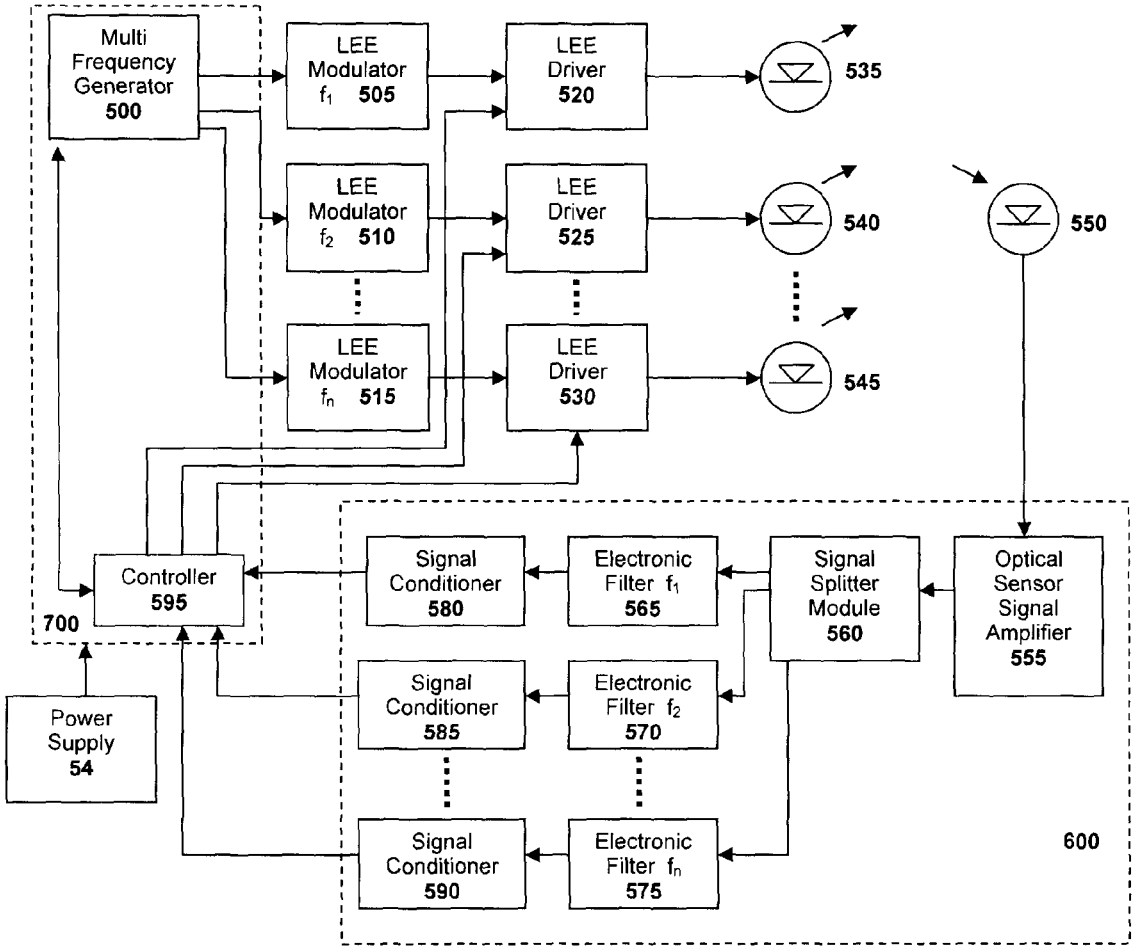
FIG. 6 illustrates a block diagram of an illumination system according to an embodiment of the present invention.

In another embodiment of the present invention, the control signals for activation of the light-emitting elements are independently controlled by PWM signals which have different PWM frequencies for different colour light-emitting elements and optionally for different illumination devices of an illumination system. The PWM signals and frequencies can be modified or selected by a control system 700 as illustrated in FIG. 6. For example a frequency $f_1$ can be selected for the red light-emitting elements 535, a frequency $f_2$ can be selected for the green light-emitting elements 540 and a pulse frequency $f_n$ can be selected for the blue light-emitting elements 545.

For example, the control system 700, via a multi frequency generator 500, can generate different PWM control signals with different PWM frequencies. The PWM control signals are provided to light-emitting element drive current modulators 505, 510 and 515 which in return provide signals to the light-emitting element drivers 520, 525 and 530 for activation of the light-emitting elements 535, 540 and 545.

In one embodiment, the output of the optical sensor 550 is coupled to a signal processing module 600 which comprises an optical sensor signal amplifier 555, wherein this signal is subsequently split by a signal splitter module 560 for transmission to the inputs of electronic filters 565, 570 and 575. For example, these electronic filters can be configured as narrow bandpass filters or other filters which allow one or more desired frequencies to pass while rejecting all others as would be readily understood by a worker skilled in the art. The center frequencies of the electronic filters 565, 570 and 575 are substantially equal to the frequencies of the PWM signals used for modification of the light-emitting element drive currents. For example, if the drive currents for the red light-emitting elements 535, green light-emitting elements 540, and blue light-emitting elements 545 are modified with PWM signals having frequencies x, y, and z, respectively, the center frequencies of the electronic filters 565, 570 and 575 are chosen to correspond to the center frequencies x, y, and z, respectively. Accordingly, the resultant signals at the outputs of the individual electronic filters 565, 570 and 575 will be directly proportional to the radiant flux outputs of the red light-emitting elements 535, green light-emitting elements 540 and blue light-emitting elements 545, respectively.

The outputs of the electronic filters 565, 570 and 575 are coupled to the controller 595. Based on the values of the radiant flux output for each colour of light-emitting element from the electronic filters 565, 570 and 575, the controller 595 can compensate for and adjust the amounts of drive current for the red light-emitting elements 535, green light-emitting elements 540, and blue light-emitting elements 545 in order to maintain the luminous flux and chromaticity of the output light at desired levels.

In one embodiment, and as illustrated in FIG. 6, the outputs of the electronic filters 565, 570 and 575 can be operatively coupled to separate signal conditioners 580, 585 and 590, prior to the transmission of the collected information to the controller 595 of the control system 700.

In one embodiment of the present invention, the pulse frequencies for the PWM signals can be generated in firmware. For example, a high-frequency oscillator can be used to divide its output signal into a required number of lower frequency signals. The required number of lower frequency signals corresponds to the number of different colour light-emitting elements used within the illumination device, the number of independently controlled arrays of light-emitting elements or other criteria as would be readily understood by a worker skilled in the art.

As is well known risks of interference from common harmonic content of different PWM signals for controlling different light-emitting elements with different PWM pulse frequencies can be desirably reduced by choosing pulse frequency combinations that divide each other with non-zero remainder, and for further reduction of interference risks, by combining frequencies that are different prime number multiples of a common frequency unit. The same principle applies when choosing amplitude modulation frequencies as described above. Therefore, embodiments of the present invention can be configured based upon these principles.

Figure 7:
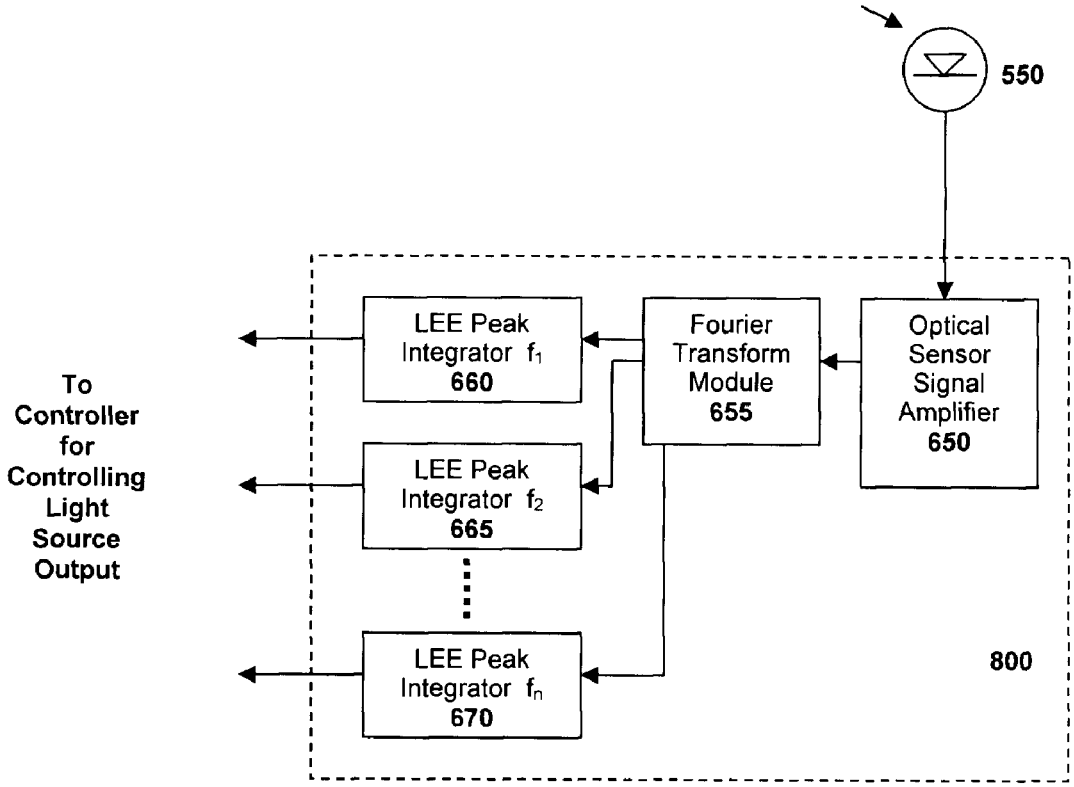
FIG. 7 illustrates a block diagram of a signal processing module according to an embodiment of the present invention.

In an alternate embodiment of the present invention, wherein each light-emitting element colour is controlled based on a different pulse frequency, as illustrated in FIG. 7, the signal processing module 800 comprises a Fourier transform module 655 which applies a Fourier transformation, to the output of the optical sensor 550. Upon the conversion of the optical signal into the frequency domain, the total strength primary and respective harmonic frequency peaks will be representative of the intensity of light emitted by light-emitting elements which are modulated using a respective primary frequency. The converted signal is subsequently processed by light-emitting element peak integrators 660, 665 and 670, wherein each of the integrators operate at one of the pulse frequencies, $\{f_1, f_2 \ldots f_n\}$ thereby determining the area under each respective set of frequency peaks which is proportional to the intensity of the light emitted by each light-emitting element colour. Together with the desired light output from the illumination device, this can provide the control system with a means for evaluation of any required adjustment of the control signals being used to control the light output of each light-emitting element colour.

In one embodiment of the present invention, the signal received from the optical sensor can be processed using a Discrete Fourier transformation such as the Goertzel method, for example.

In another embodiment of the present invention, one or more illumination devices comprise a single array of one or more similar light-emitting elements. In this configuration, the light-emitting elements can be of nominally the same monochromatic wavelength or the light-emitting elements could be white light LEDs containing photo-luminescent material such as certain phosphor materials, for example. The average intensities of each illumination device can be maintained substantially constant despite changes in ambient temperature and/or possible light interference from other illumination devices.

In one embodiment of the present invention, a modification signal is configured using an analog code. In addition, a first analog code for configuration of a first modification signal can be orthogonal to a second analog code for configuration of a second modification signal. The first modification signal can be associated with a first array of light-emitting elements and the second modification signal can be associated with a second array of light-emitting elements.

In another embodiment of the present invention, a modification signal is configured using a digital code. In addition, a first digital code for configuration of a first modification signal can be orthogonal to a second digital code for configuration of a second modification signal. The first modification signal can be associated with a first array of light-emitting elements and the second modification signal can be associated with a second array of light-emitting elements.

It is obvious that the foregoing embodiments of the invention are exemplary and can be varied in many ways. Such present or future variations are not to be regarded as a departure from the spirit and scope of the invention, and all such modifications as would be obvious to one skilled in the art are intended to be included within the scope of the following claims.

The disclosure of all patents, publications, including published patent applications, and database entries referenced in this specification are specifically incorporated by reference in their entirety to the same extent as if each such individual patent, publication, and database entry were specifically and individually indicated to be incorporated by reference.

We claim:

1. An illumination device for generating output light having a desired luminous flux and chromaticity, the illumination device comprising:

(a) at least one first array of one or more light-emitting elements adapted to generate first light having a first spectral power distribution, and at least one second array of one or more light-emitting elements adapted to generate second light having a second spectral power distribution different than the first spectral power distribution, the output light being a combination of the first light and the second light;

(b) a first current driver operatively coupled to the first array for selectively supplying electrical drive current to the first array based on a first control signal, and a second current driver operatively coupled to the second array for selectively supplying electrical drive current to the second array based on a second control signal;

(c) an optical sensor for sensing a portion of the output light, the optical sensor configured to generate an optical signal representative of the mixed radiant flux of the output light; and (d) a controller operatively coupled to the first current driver, second current driver, and the optical sensor and configured to generate the first control signal and second control signal based at least on the characteristics of the first light and second light, respectively, and the desired luminous flux and chromaticity of the output light, wherein the first control signal at least in part configured using a first modification signal and the second control signal at least in part configured using a second modification signal, the controller being configured to electronically filter the optical signal based on the first modification signal and second modification signal thereby determining optical characteristics of the first light and second light, wherein the first control signal is a pulse width modulated signal or a pulse code modulated signal and the second control signal is a pulse width modulated signal or a pulse code modulated signal.

2. The illumination device according to claim 1, wherein the first modification signal is a first amplitude modulation signal and the second modification signal is a second amplitude modulation signal.

3. The illumination device according to claim 1, wherein the first modification signal is a first amplitude modulation signal with constant modulation depth and the second modification signal is a second amplitude modulation signal with constant modulation depth.

4. The illumination device according to claim 1, wherein the first modification signal is a first amplitude modulation signal with variable modulation depth and the second modification signal is a second amplitude modulation signal with variable modulation depth.

5. The illumination device according to claim 1, wherein the first modification signal is a pulse width modulation signal having a first frequency and the second modification signal is a pulse width modulation signal having a second frequency.

6. The illumination device according to claim 1, wherein the first modification signal is configured using a first analog code and the second modification signal is configured using a second analog code, wherein the first analog code is orthogonal to the second analog code.

7. The illumination device according to claim 1, wherein the first modification signal is configured using a first digital code and the second modification signal is configured using a second digital code, wherein the first digital code is orthogonal to the second digital code.

8. The illumination device according to claim 1, wherein the controller is configured to process the optical signal based on a Discrete Fourier transformation.

9. The illumination device according to claim 1, wherein the controller is configured to determine the first modification signal and the second modification signal.

10. The illumination device according to claim 1, wherein the first modification signal has a first frequency and the second modification signal has a second frequency, wherein the first frequency and the second frequency have a predetermined correlation.

11. The illumination device according to claim 1, wherein the first modification signal has a first frequency and the second modification signal has a second frequency, wherein the first frequency and the second frequency divide each other with non-zero remainder.

12. The illumination device according to claim 1, wherein the first modification signal has a first frequency and the second modification signal has a second frequency, wherein the first frequency and the second frequency are different prime number multiples of a common frequency unit.

13. The illumination device according to claim 1, wherein the controller is configured to detect modification signal frequencies of one or more other illumination devices.

14. A method for generating output light of a desired luminous flux and chromaticity, the method comprising the steps of:

(a) generating a first drive current for at least one first array of one or more light-emitting elements at least in part using a first modification signal;

(b) generating a second drive current for at least one second array of one or more light-emitting elements at least in part using a second modification signal;

(c) generating an optical signal representative of output light characteristics, the output light being a mixture of light emitted by the at least one first array and the at least one second array;

(d) electronically filtering the optical signal based on the first modification signal thereby obtaining a first radiant flux representative of light emitted by the first array;

(e) electronically filtering the optical signal based on the second modification signal thereby obtaining a second radiant flux representative of light emitted by the second array;

(f) comparing a combination of the first radiant flux and second radiant flux with the desired luminous flux and chromaticity; and (g) adjusting at least one of the first drive current and the second drive current, wherein the first modification signal is a pulse width modulation signal having a first frequency and the second modification signal is a pulse width modulation signal having a second frequency.

15. The method according to claim 14, wherein the first modification signal is a first amplitude modulation signal and the second modification signal is a second amplitude modulation signal.

16. The method according to claim 14, wherein the optical signal is representative of only light emitted by the one or more first arrays and one or more second arrays.

17. The method according to claim 14, wherein the optical signal is representative of the light emitted by the one or more first arrays and one or more second arrays and ambient light.

18. The method according to claim 14, further comprising processing the optical signal based on a Discrete Fourier transformation.

19. An illumination device for generating output light having a desired luminous flux and chromaticity, the illumination device comprising:

(a) at least one first array of one or more light-emitting elements adapted to generate first light having a first spectral power distribution, and at least one second array of one or more light-emitting elements adapted to generate second light having a second spectral power distribution different than the first spectral power distribution, the output light being a combination of the first light and the second light;

(b) a first current driver operatively coupled to the first array for selectively supplying electrical drive current to the first array based on a first control signal, and a second current driver operatively coupled to the second array for selectively supplying electrical drive current to the second array based on a second control signal;

(c) an optical sensor for sensing a portion of the output light, the optical sensor configured to generate an optical signal representative of the mixed radiant flux of the output light; and (d) a controller operatively coupled to the first current driver, second current driver, and the optical sensor and configured to generate the first control signal and second control signal based at least on the characteristics of the first light and second light, respectively, and the desired luminous flux and chromaticity of the output light, wherein the first control signal at least in part configured using a first modification signal and the second control signal at least in part configured using a second modification signal, the controller being configured to electronically filter the optical signal based on the first modification signal and second modification signal thereby determining optical characteristics of the first light and second light, wherein the first control signal is a pulse width modulated signal or a pulse code modulated signal and the second control signal is a pulse width modulated signal or a pulse code modulated signal.

* * * * *